US005848760A

United States Patent [19]

Krüger et al.

[11] Patent Number: 5,848,760

[45] Date of Patent: Dec. 15, 1998

[54] CARRIER ROLL WINDING MACHINE HAVING BLOW BOX AND WEB SEVERING

[75] Inventors: Jens Krüger, Heidenheim; Rudolf Beisswanger, Steinheim; Walter Kaipf, Haunsheim, all of Germany

[73] Assignee: Voith Sulzer Papiermaschinen GmbH, Germany

[21] Appl. No.: 733,795

[22] Filed: Oct. 18, 1996

[30] Foreign Application Priority Data

Oct. 19, 1995 [DE] Germany ..... 195 38 973.5

[51] Int. Cl.[6] ..... B65H 35/08

[52] U.S. Cl. ..... 242/527; 247/542

[58] Field of Search ..... 242/527, 541.7, 242/541.4, 542, 542.2, 526

[56] References Cited

U.S. PATENT DOCUMENTS

| | | | |
|---|---|---|---|
| 2,461,387 | 2/1949 | Medbery . | |
| 3,346,209 | 10/1967 | Cronin | 242/541.7 |
| 3,497,151 | 2/1970 | Voss et al. | 242/541.7 |
| 3,515,183 | 6/1970 | Voss | 242/541.7 |
| 4,541,585 | 9/1985 | Frye et al. . | |
| 4,565,337 | 1/1986 | Mondini et al. | 242/541.7 |
| 5,478,026 | 12/1995 | Schonmeier et al. | 242/542 X |
| 5,492,287 | 2/1996 | Raudaskoski et al. | 242/541.4 |
| 5,562,261 | 10/1996 | Beisswanger et al. | 242/541.7 X |

FOREIGN PATENT DOCUMENTS

| | | |
|---|---|---|
| 0631955 | 1/1995 | European Pat. Off. . |
| 0631956 | 1/1995 | European Pat. Off. . |
| 631955 | 1/1995 | European Pat. Off. . |
| 631956 | 1/1995 | European Pat. Off. . |
| 0665178 | 8/1995 | European Pat. Off. . |
| 496863 | 11/1995 | European Pat. Off. . |
| 678585 | 6/1939 | Germany . |
| 1047001 | 12/1958 | Germany . |
| 2757247 | 7/1978 | Germany . |
| 7310606 | 10/1980 | Germany . |
| 3839244 | 12/1993 | Germany . |
| 92 03366 | 3/1992 | WIPO . |

OTHER PUBLICATIONS

*Patent Abstracts of Japan*, vol. 10, No. 96, Apr. 12, 1996 & JP 60 232358, Nov. 19, 1985.

*Primary Examiner*—Donald P. Walsh
*Assistant Examiner*—William A. Rivera
*Attorney, Agent, or Firm*—Ostrolenk, Faber, Gerb & Soffen, LLP

[57] ABSTRACT

A carrier roll winding machine for winding up a web, such as a paper web. Two carrier rolls form a winding bed for a reel and the reel is fed with a web wrapped around the bottom of and then passing between the two rolls and to the reel. A blow box beneath the space between the carrier rolls having a compressed air connection. The blow box has a respective wall at each of the carrier rolls and a sealing element at each of the walls sealing to the respective carrier roll. The region, of at least one wall or of both walls, supporting the sealing element are movable from the sealing position to a non-sealing position either by translatory movement or pivoting movement with reference to the remaining stationary wall parts of the blow box. A web severing device is movable to sever the web when a wall portion and sealing element are moved away from the carrier roll permitting the severing device to pass to the web.

17 Claims, 4 Drawing Sheets

CARRIER ROLL WINDING MACHINE HAVING BLOW BOX AND WEB SEVERING

BACKGROUND OF THE INVENTION

The invention relates to a winding machine for winding up a continuous paper web, and particularly to a blow box for use with the machine and to a web severing device which cooperates with the blow box.

When endless webs, particularly paper webs, are wound on a roll, the winding hardness, or web tautness or tension is important for the following further processing of the web. Particularly for paper webs, it is critical that the winding hardness, or web tautness or tension have a specific profile over the entire diameter of the reel. In general, the winding hardness should drop from a certain initial value radially inward to an end value radially outward. The drop should be as uniform as possible from the first layer to the last layer. It should have a certain gradient, i.e., it should not be too steep or too shallow. The profile of the winding hardness should not change abruptly, e.g., drop suddenly.

The desired winding hardness profile is only achieved if certain measures are taken. If such measures are not taken in contrast, then as the diameter of the reel increases, the line pressure between the reel and the carrier roll or the carrier rolls becomes increasingly greater, as does also the winding hardness.

In order to avoid this, known winding machines use compressed air, which enters through a compressed air connection into a pressure tight chamber beneath the paper reel. In this arrangement, the air volume or air pressure can be controlled according to the increasing weight of the reel. It is also possible to divide the pressure tight chamber into individual chambers over its length, i.e., over the web width, and to provide each individual chamber with a pressure connection. This also makes it possible to compensate for sagging of the reel.

Furthermore, so-called rider rolls are arranged on parallel axes with respect to the carrier rolls. These rider rolls exert pressure on the reel. The bearing pressure is controlled to be initially high and to become gradually and generally correspondingly lower as the weight of the reel being wound increases.

The rider roll thus enables both line pressure and winding hardness to be influenced and controls these in a desired manner. However, if a reel of very large diameter is produced, then the line pressure is also very high in the end phase of the winding operation. The winding tension therefore increases. But this may result in the web tearing or in creases occurring.

Another measure for influencing the winding hardness includes distributing the load of the reel over the individual carrier rolls. For this purpose, it is known to provide carrier rolls of the same diameter in different horizontal planes or levels or to use carrier rolls of different diameters. Furthermore, it is known that a harder winding is obtained by using a carrier roll of smaller diameter than by using a carrier roll of larger diameter.

DE-DM 7 310 606 discloses a winding machine which has two carrier rolls of the same size. During a winding operation, one of these carrier rolls can be lowered from an upper position which is above the horizontal plane of the axis of the other carrier roll at the beginning of the winding operation. This lowering operation is intended to produce a core which is wound firmly from the start.

U.S. Pat. No. 2,461,387 discloses a winding machine which has two driven carrier rolls of different diameters. The smaller diameter carrier roll has a covering with a larger coefficient of friction and is driven at a higher speed than the other carrier roll. This subjects the outer layer of the web to tensile stretching.

DE-OS 27 57 247 relates to a winding machine with carrier rolls of the same diameter. The winding hardness is controlled by changing the mutual spacing of the carrier rolls.

DE-PS 678 585 describes a winding machine with two carrier rolls. One roll has a hard lateral surface and the other has a pliable lateral surface. The axes of the two rolls are located in the same horizontal plane.

DE 38 39 244 describes a winding machine with three carrier rolls. The first carrier roll is stationary, while the following two carrier rolls can be changed in position and have a supporting belt wrapped around them. By changing the supporting belt and/or the positions of the second and third carrier rolls, the winding hardness should be controlled over the diameter of the reel, i.e., from the inner layer outward. It is intended that the supporting belt effect as large a supporting surface as possible for the purpose of lowering the surface weight. This winding machine involves an extremely high outlay. Moreover, it has the significant disadvantage that as soon as the paper reel has increased in size such that it is predominantly carried by the supporting belt, severe vibration of the supporting belt may occur. As a result, the paper reel begins to "dance" and may even be catapulted out of the bed.

For a winding machine with two carrier rolls, it has also already been proposed to produce the lateral surfaces of the two rolls from rubber. In this case, the carrier rolls have the same diameter and the lateral surfaces have the same rubber hardness. However, this also produces vibrating and floating of the paper reel.

EP 0 157 062 B1 describes a winding machine having two carrier rolls and a rider roll. The lateral surfaces of all these rolls are formed from a multiplicity of individual fluid chambers which are arranged axially one beside the other. With the formation of joints, the chambers define the entire lateral surface of the roll by means of their individual lateral surfaces. The support behavior of such a roll is naturally non-uniform over the width of the web due to the multiplicity of joints.

The present invention is based on EP 919 147 63. That known winding machine includes a blow box at the carrier rolls that can be removed from its operating position by pivoting or translatory movement. A severing device can be moved into its operating position after the removal of the blow box.

One disadvantage of this known embodiment is described. The blow box has a quite considerable overall volume and a correspondingly high weight. The box extends over the entire length of the winding bed, which may measure several meters. It weighs several hundred kilograms. For moving the blow box, a high outlay movement mechanism having a corresponding drive is required. Moreover, the translatory or pivoting movement of the blow box takes up a quite considerable amount of space, which is often not available.

SUMMARY OF THE INVENTION

The object of the invention is to provide a winding machine having carrier rolls and a blow box. The box may be stationary to avoid need for a high outlay movement mechanism with associated drive and also so that a smaller space is sufficient for the whole machine.

The invention comprises a carrier roll winding machine for winding up a web, such as a paper web. Two carrier rolls form a winding bed for a reel and the reel is fed with a web that first wraps around the bottom of one roll and then between the two rolls, passing to the reel.

A blow box is located beneath the space between the carrier rolls. It has a compressed air connection. The blow box has a respective wall at each of the carrier rolls. A respective sealing element at the end, i.e., the top edge of each of the walls, seals to the respective carrier roll. The portion of each wall supporting its sealing element is movable from the sealing position to a non-sealing position, either by translatory movement or pivoting movement with reference to the remaining stationary walls of the blow box.

A web severing device is movable to sever the web when a wall part and its sealing element are moved away from the carrier roll permitting the severing device to pass to the web.

The blow box remains stationary after initial assembly of the machine. Only a comparatively small part of the blow box is made displaceable or removable, namely those wall parts which carry relevant sealing elements for sealing to the relevant carrier roll.

The severing device is configured and arranged such that it can be moved into its operating position along a path between the second carrier roll, the roll which does not have the material web wrapped around it, and the relevant pivoted away or moved away wall part with its associated sealing element. The severing device may sever the web, e.g., each time that winding of a material web reel is finished.

In some cases it may be sufficient for only that wall part of the blow box having an associated sealing element which seals to the second carrier roll to be moveable in a translatory or pivotable manner. Generally, however, this movability is also provided for the other wall part, which seals to the first carrier roll.

Other features and advantages of the present invention will become apparent from the following description of the invention which refers to the accompanying drawings.

DETAILED DESCRIPTION OF THE INVENTION

Figure 1:
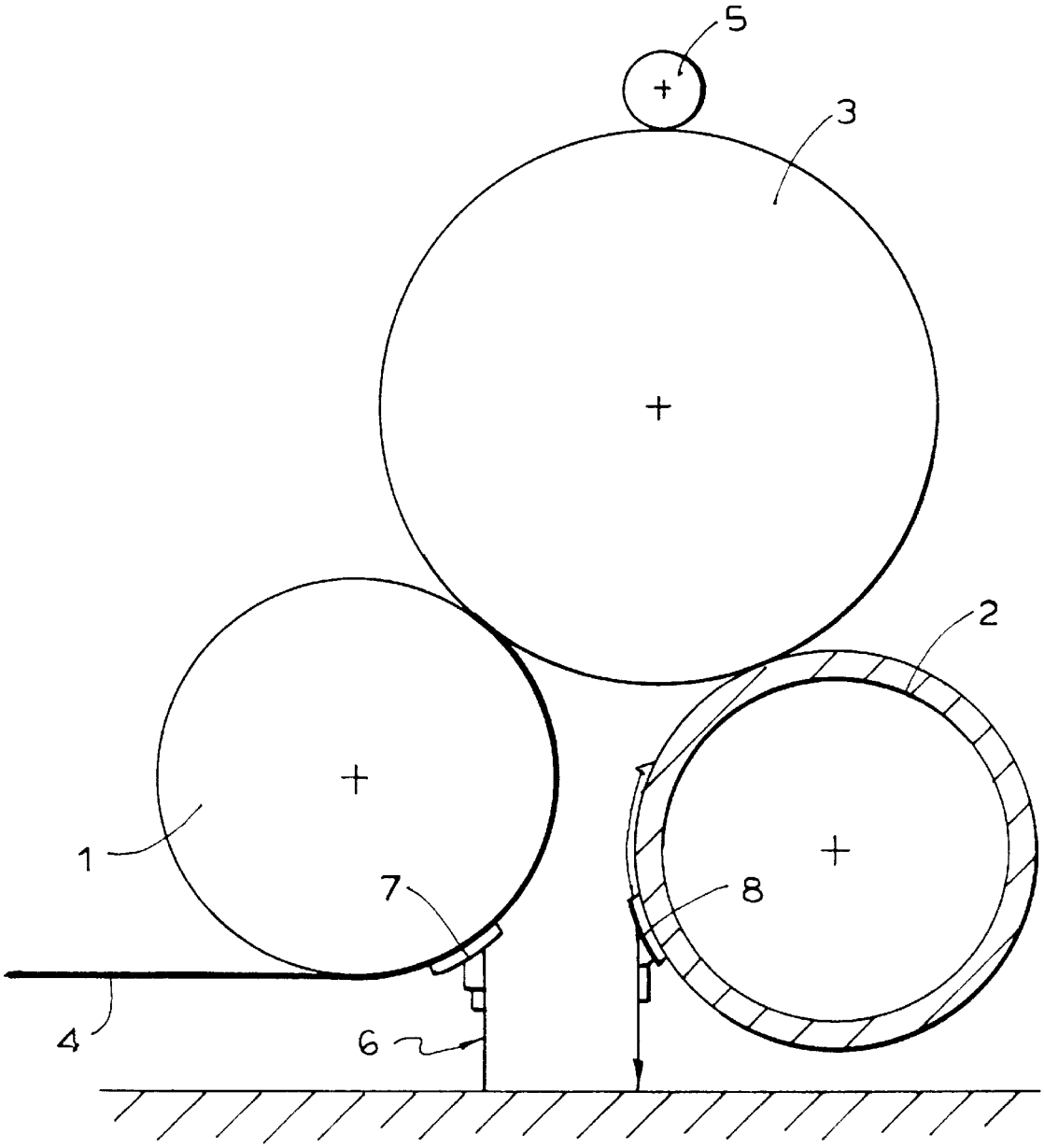
FIG. 1 schematically shows a winding device with two carrier rolls.

FIG. 1 shows a winding machine with two carrier rolls 1, 2, which together form a winding bed for receiving a wound paper web reel 3. The rolls are near each other, but are spaced apart and are parallel. The paper reel 3 is made by winding up a paper web 4. The paper web 4 is advanced from the bottom left and initially wraps around the underside of the first carrier roll 1 and passes up between the rolls 1 and 2 to the reel above the rolls. The paper reel 3 is loaded in a controllable manner by a loading or rider roll 5, in order to influence the bearing pressure of the reel against the rolls 1, 2.

A blow box 6 is located generally between and below the two carrier rolls beneath the space between the rolls. The blow box is indicated only schematically in FIG. 1. The blow box is defined by first and second walls including top ends respectively at the first and second rolls. The walls support respective sealing elements 7, 8 at their top ends. Sealing elements 7, 8 produce a seal between the respective walls of the blow box 6 on which the sealing elements are disposed and the respective carrier roll 1 or 2.

Figure 2:
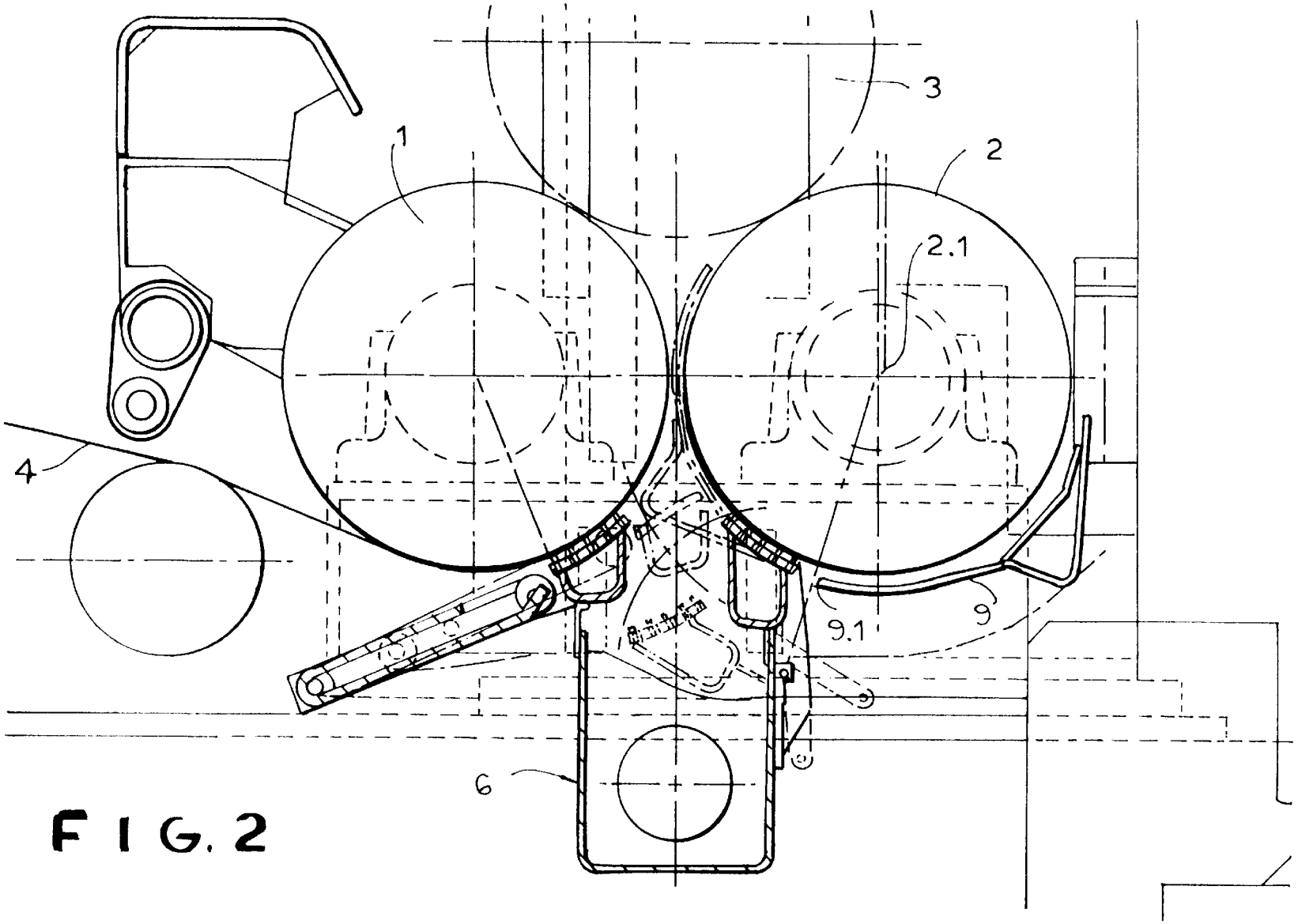
FIG. 2 is a lateral cross-section through one embodiment of such a device.

FIG. 2 is an enlarged illustration of the main parts shown in FIG. 1, including the two rolls 1, 2, the paper reel 3 indicated by chain-dotted lines, the paper web 4 advanced from the left, and the blow box 6.

A web severing device 9 has a cutting edge 9.1 at its left hand end. The severing device 9 can be pivoted around a pivot center, here the axis 2.1 of the roll 2. However, the pivot center could also be offset to some extent with respect to the axis 2.1. The severing device 9 is of essentially arcuate configuration.

Figure 3:
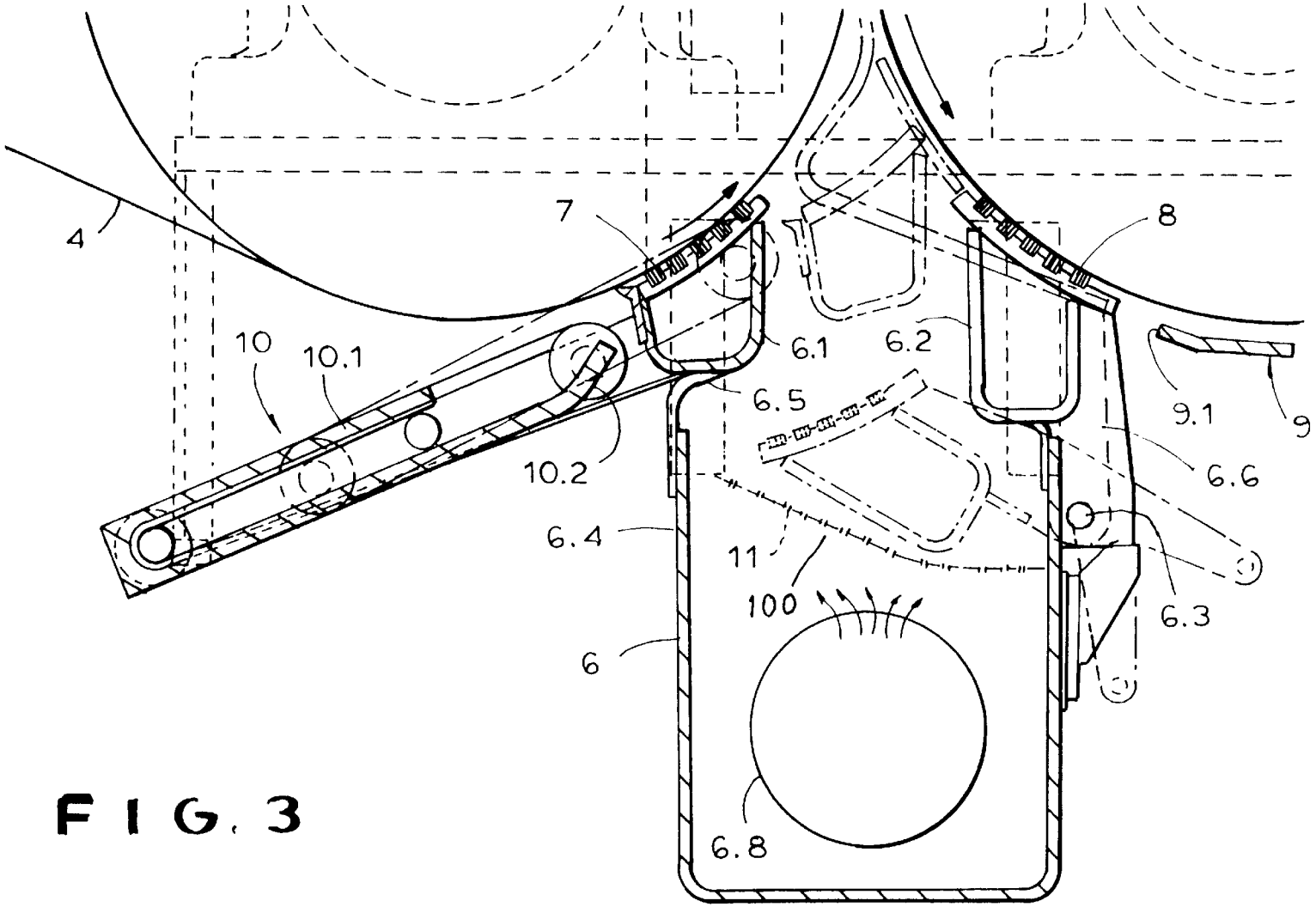
FIG. 3 shows details of the blow box in FIG. 2.

Details of the blow box 6 are seen in FIG. 3. The blow box 6 has first and second side walls which extend toward the rolls and include top ends or edges respectively at the carrier rolls 1 and 2. Respective seals 7, 8 are at the top ends of the side walls and seal to the rolls 1, 2. The seal 7 is carried by a wall component 6.1, and the seal 8 is carried by a wall component 6.2. The two components 6.1 and 6.2 are parts of the respective side walls of the blow box 6. In this side view, the wall parts 6.1 and 6.2 are essentially U-shaped in order to increase their rigidity. However, this shaping is not required. The wall parts 6.1 and 6.2 are constituent parts of the blow box 6.

Wall part 6.1 can be moved in a translatory manner, toward or away from the carrier roll 2. Note the alternate position of the wall part 6.1 illustrated by dashed lines. Wall part 6.2 is pivotably mounted on the main part of the blow box 6 to pivot around pivot axis 6.3. Wall part 6.2 can be pivoted into the position illustrated by chain-dotted lines which is located in the interior of the main part of the blow box 6.

A guide device 10 moves the wall part 6.1 in a translatory manner. The guide device comprises a guide bushing 10.1, which has the form of a hairpin in cross section. The guide bushing extends over the entire width of the two carrier rolls 1, 2. Guide rollers which can run in the guide bushing 10.1, act on the wall part 6.1 via connecting levers (not shown). The lower leg of the guide bushing 10.1 has an upwardly bent off end 10.2. This raises the wall part 6.1 slightly at the end region of its travel.

The wall part 6.1 exclusively comprises the U-shaped structure. The wall 6.4 of the box 6, located beneath the wall part 6.1, is always stationary. A seal 6.5 is provided between the U-shaped wall part 6.1 and the remainder of the wall 6.4 located beneath it.

The second wall part 6.2 comprises both the U-shaped structure and also a bracket 6.6. The bracket 6.6 is articulated, by the pivot axis 6.3, on a stationary wall 6.7. That is located beneath the bracket of the blow box 6.

When the winding machine starts operation, the leading end of the paper web 4, which is seen on the left of the drawing, is advanced to and is guided around the carrier roll 1. In order to be able to introduce the leading end as easily as possible, for example with the aid of air nozzles, the wall part 6.1 is moved in a translatory manner from its solid line into its chain dotted lines position. When the beginning of the paper web has been wound on around a winding sleeve or core (not shown), then the wall part 6.1 is returned in a translatory manner out of its operating position, as illustrated by solid lines. Sealing element 7, which is generally a labyrinth seal, is again located directly opposite the lateral surface of carrier roll 1.

After winding of a paper reel 3 has finished, the machine is brought to a standstill. The second wall part 6.2 is then pivoted into its chain-dotted lines position. The severing device 9 is pivoted in the direction of the winding bed until it assumes the operating position, also illustrated by chain-dotted lines, in which it severs the paper web. Then, the paper reel is rolled, either simultaneously or subsequently, to the right, over the carrier roll 2 and is thus ejected from the winding bed.

The apparatus has another advantageous device. A connecting wall 11 in FIG. 3 connects the first fixed wall 6.4 to the second fixed wall 6.7 of the blow box. Furthermore, the wall 11 extends over the entire axial length of the blow box. The wall 11 is perforated with a multiplicity of perforation 5 or bores 108. The bores may be distributed uniformly over the surface of the connecting wall 11 or may be otherwise distributed, if desired.

The connecting wall 11 has several functions. First, it reinforces the blow box 6. Second, it uniformly distributes compressed air, which is fed to the blow box 6 at one or at both lateral end sides through feed line 6.8, over the cross section of the blow box 6.

There is a third important function. In a carrier-roll winding machine, the paper web periodically tears and the paper web then drops into the blow box. This waste paper has to be removed as quickly as possible. The connecting wall 11 intercepts the falling waste paper so that it does not fall on the floor or base of the box 6. Waste paper sitting on the connecting wall 11 can be removed much more easily out of one of the two lateral end sides of the blow box 6 than could be paper located on the base of the blow box 6. The removal of the waste paper may also be automated, for example by means of a scraper or of a circulating conveying belt.

In a further embodiment, the perforations of the connecting wall may be distributed in a specific pattern. For example, the size or number of the perforations or bores 100 in the connecting wall may decrease toward the lateral end regions. This could be expedient because it is precisely in the central region that the paper reel sags to a particularly pronounced extent.

Finally, the connecting wall 11 could also have a shutter enabling the throughput of the individual compressed air streams which pass through the bores of the connecting wall 11 to be changed as needed.

Figure 4:
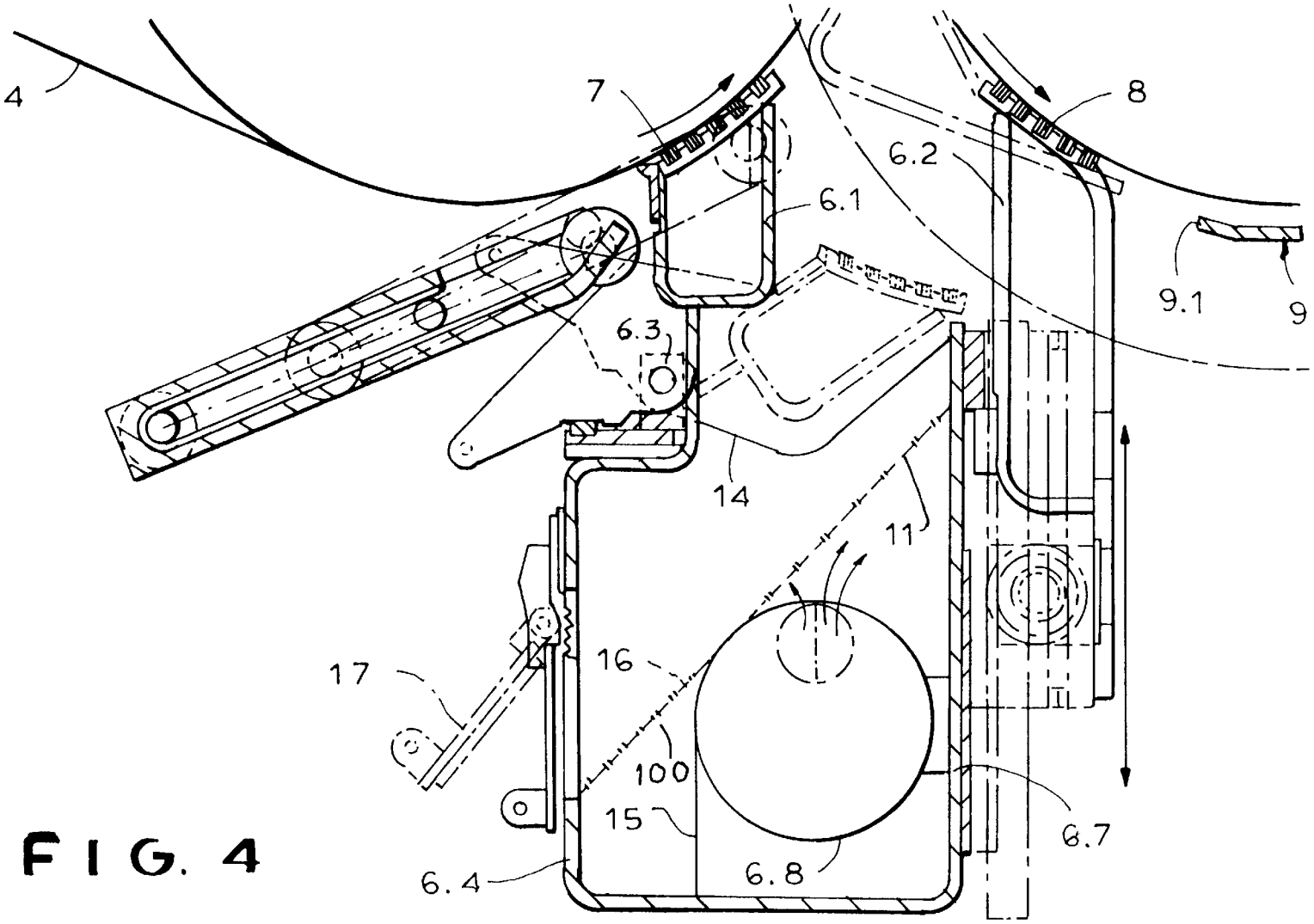
FIG. 4 shows a second embodiment of a blow box.

A further embodiment of the invention is illustrated in FIG. 4. The blow box 6 has its two seals 7, 8. The wall part 6.1 is now mounted pivotably, as on pivot axis 6.3, and is pivotable to the position of the wall part 6.1 which is illustrated by dashed lines. The wall part 6.2, on the other hand, is fitted on the blow box such that it can be moved in a translatory manner particularly, in a vertical direction, along the path shown by the arrow. The advantage of this design is that, when the carrier drum 2 passes into the chain-dotted position, e.g., the drum 2 has to be pivoted away because the paper web tears and wraps around the carrier drum, the sealing element 8 is automatically moved downwardly in a translatory manner together with the carrier drum 2.

Further, the blow box 6 in FIG. 4 has reinforcing ribs 14 which connect the fixed wall 6.4 to the fixed wall 6.7 of the blow box. Metal plates 15 fitted around the air-feed line 6.8 of the blow box fasten the air feed line in the blow box.

As in the blow box of FIG. 3, a connecting wall 11 is also provided. That connecting wall is perforated and intercepts the residual paper that falls into the box when the paper web is torn. The connecting wall 11 is inclined between the fixed walls 6.4 and 6.7, such that the residual paper slides across the blow box and accumulates in front of the opening 16 in the fixed wall 6.4. It is possible to remove the collected residual paper easily after opening the flap 17 arranged in front of the opening 16.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A carrier roll winding machine for winding up an endless web, the machine comprising:

first and second carrier rolls which extend generally parallel to each other, are spaced apart yet close enough for defining a winding bed for receiving a reel to be supported on the rolls for winding the reel of web material, wherein the web is guided to the reel by running in from below the first roll and wrapping around the first roll to pass between the rolls to the reel;

a blow box disposed below the carrier rolls and extending beneath the space between the rolls, the blow box being defined by a first wall located below and stationary in position with reference to the position of the first carrier roll and having an end extending toward the first carrier roll and by a second wall located below and stationary in position with reference to the position of the second carrier roll and having an end extending toward the second carrier roll;

sealing elements at the ends of the walls for sealing the first and second walls to the first and second rolls, respectively;

at least one of the first and second walls including a wall part movable with respect to the well supporting the respective sealing element and the movable wall part being movable so as to selectively move the respective sealing element at the end thereof, whereby the sealing element on the movable wall part is a movable sealing element, movable away from and toward the position sealing to the respective carrier roll;

a connection into the blow box for compressed air;

a web severing device movable with reference to the blow box and the carrier rolls between a non-severing position located outside the blow box and an operating position located inside the blow box at which the severing device may sever the web which is moving toward the reel; the severing device being shaped and supported to be movable between the respective carrier roll and the movable sealing element that has been moved away from the sealing position as the severing device is moved from outside to inside the blow box into the operating position thereof for severing the web, and from inside to outside the blow box to the non-severing position.

2. The machine of claim 1, wherein the movable wall part is a region of the one wall that is movable with respect to the rest of the one wall.

3. The machine of claim 2, wherein the movable wall part is supported to the blow box so as to be pivotable with respect to the blow box together with the movable sealing element on that wall part to be pivotable around an axis running parallel to the axis of the carrier roll.

4. The machine of claim 2, wherein the movable wall part and the respective movable sealing element thereon are supported for movement in a translatory manner from the position where the movable sealing element seals to the respective carrier roll to the position where the sealing element is moved away from the respective carrier roll.

5. The machine of claim 4, wherein the second wall includes the wall part thereof.

6. The machine of claim 4, wherein both of the first and second wall parts are movable;

the first wall part and the respective first sealing element thereon are supported for movement in a translatory manner from the position where the first sealing element seals to the respective carrier roll to the position where the first sealing element is moved away from the respective carrier roll; and the second wall part and the respective second sealing element thereon are supported to the blow box so as to be pivotable with respect to the blow box around an axis running parallel to the axes of the carrier rolls.

7. The machine of claim 2, wherein each of the first and second walls includes respective first and second wall parts at which the respective sealing elements for each wall is positioned;

at least one of the wall parts being movable between a position where the respective sealing element is at the respective carrier roll and a position where the respective sealing element is moved away from sealing to the respective carrier roll.

8. The machine of claim 7, wherein the one wall part is supported to the blow box so as to be pivotable with respect to the blow box together with the movable sealing element on that wall part and to be pivotable around an axis running parallel to the axes of the carrier rolls.

9. The machine of claim 7, wherein the one wall part and the respective movable sealing element thereon are supported for movement in a translatory manner from the position where the movable sealing element seals to the respective carrier roll to the position where the movable sealing element is away from the respective carrier roll.

10. The machine of claim 9, wherein the second wall includes the wall part thereof.

11. The machine of claim 7, wherein the first and second walls have non-moving parts; and a connecting wall is disposed between the non-moving parts of the first and second walls and extends substantially alone a length of the box.

12. The machine of claim 11, wherein the connecting wall is fixed on the first and second walls.

13. The machine of claim 11, further comprising an opening in at least one of the first and second walls providing access to the connecting wall enabling removal of paper from the connecting wall.

14. The machine of claim 13, wherein the connecting wall is inclined between the first and second walls in a direction so that paper on the connecting wall slides toward the opening in the one wall.

15. The machine of claim 11, wherein the air connection to the blow box is below the connecting wall.

16. The machine of claim 15, wherein the connecting wall has perforations for transmitting air.

17. The machine of claim 16, further comprising an opening in at least one of the first and second walls providing access to the connecting wall enabling removal of paper from the connecting wall; and the connecting wall is inclined between the first and second walls in a direction so that paper on the connecting wall slides toward the opening in the one wall.

* * * * *